US011622635B2

(12) United States Patent
Gladney et al.

(10) Patent No.: US 11,622,635 B2
(45) Date of Patent: Apr. 11, 2023

(54) MATTRESS ASSEMBLY

(71) Applicant: Dreamwell, Ltd., Doraville, GA (US)

(72) Inventors: Richard F. Gladney, Fairburn, GA (US); Sheri McGuire, Duluth, GA (US); Lindsey Sieber, Doraville, GA (US)

(73) Assignee: DREAMWELL, LTD., Doraville, GA (US)

( * ) Notice: Subject to any disclaimer, the term of this patent is extended or adjusted under 35 U.S.C. 154(b) by 0 days.

(21) Appl. No.: 16/928,478

(22) Filed: Jul. 14, 2020

(65) Prior Publication Data

US 2021/0022520 A1 Jan. 28, 2021

Related U.S. Application Data

(60) Provisional application No. 62/879,119, filed on Jul. 26, 2019.

(51) Int. Cl.

| | |
|---|---|
| ***A47C 27/05*** | (2006.01) |
| ***A47C 27/14*** | (2006.01) |
| ***A47C 27/15*** | (2006.01) |
| ***A47C 31/00*** | (2006.01) |

(52) U.S. Cl.

CPC ..... *A47C 27/15* (2013.01); *A47C 27/144* (2013.01); *A47C 31/00* (2013.01)

(58) Field of Classification Search

CPC ..... A47C 27/056; A47C 27/14; A47C 27/142; A47C 27/144; A47C 27/05; A47C 27/053

See application file for complete search history.

(56) References Cited

U.S. PATENT DOCUMENTS

| | | | | |
|---|---|---|---|---|
| 5,325,552 | A * | 7/1994 | Fong | A47C 27/05 5/724 |
| 5,353,455 | A * | 10/1994 | Loving | A47C 23/002 29/451 |
| 5,459,896 | A * | 10/1995 | Raburn | A47C 7/021 5/653 |
| 7,120,956 | B1 * | 10/2006 | Liao | A47C 23/002 5/719 |
| 7,661,165 | B2 * | 2/2010 | Piccinini | A47C 27/20 5/720 |
| 7,690,096 | B1 | 4/2010 | Gladney et al. | |

(Continued)

*Primary Examiner* — David R Hare
*Assistant Examiner* — Ifeolu A Adeboyejo
(74) *Attorney, Agent, or Firm* — Cantor Colburn LLP

(57) ABSTRACT

Mattress assemblies that provide user comfort and increased airflow generally include a viscoelastic thermally conductive infused polyurethane foam top layer; a composite comprising a bottom layer, a molded viscoelastic middle foam layer, and a perforated top viscoelastic foam layer, wherein the molded viscoelastic middle foam layer comprises a plurality of interconnected substantially parallelpipedal bodies, wherein each parallelpipedal body includes an opening extending from a bottom surface to a top surface and is separated from an adjacent parallelpipedal body by a V-shaped notch, and wherein the perforated top viscoelastic foam layer comprises a plurality of perforations extending from a bottom surface to a top surface thereof, wherein at least a portion of the perforations overlies the opening in the parallelpipedal bodies; and a base core layer, wherein the composite overlies the base core layer.

19 Claims, 4 Drawing Sheets

(56) References Cited

U.S. PATENT DOCUMENTS

| | | | | |
|---|---|---|---|---|
| 8,099,812 | B2 * | 1/2012 | Steppat | A47C 27/15 5/719 |
| 8,621,694 | B2 * | 1/2014 | Farley | A47C 27/144 5/730 |
| 2006/0179580 | A1 * | 8/2006 | Robertson | A47C 27/148 5/730 |
| 2006/0288490 | A1 * | 12/2006 | Mikkelsen | A47C 7/029 5/740 |
| 2010/0005595 | A1 | 1/2010 | Gladney et al. | |
| 2010/0218318 | A1 * | 9/2010 | Steppat | A47C 27/148 5/690 |
| 2015/0289669 | A1 * | 10/2015 | Reynolds | A47C 27/144 5/690 |
| 2018/0110341 | A1 * | 4/2018 | Reynolds | A47C 21/044 |
| 2019/0153286 | A1 | 5/2019 | Peterson et al. | |
| 2019/0320811 | A1 * | 10/2019 | Malkiewicz | A47C 27/148 |

* cited by examiner

MATTRESS ASSEMBLY

CROSS REFERENCE TO RELATED APPLICATIONS

The present application claims the benefit of U.S. Provisional Application No. 62/879,119, filed on Jul. 26, 2019, which is incorporated herein by reference in its entirety.

BACKGROUND

The present disclosure generally relates to mattress assemblies.

Foam mattresses such as those formed of polyurethane foam, latex foam, and the like, are generally known in the art. One of the ongoing problems associated with foam mattress assemblies is user comfort. To address user comfort, these mattresses are often fabricated with multiple foam layers having varying properties such as density and hardness, among others, to suit the needs of the intended user. More recently, manufacturers have employed so called memory foam, also commonly referred to as viscoelastic foams, which are generally a combination of polyurethane and one or more additives that increase foam density and viscosity, thereby increasing its viscoelasticity. These foams are often open cell foam structures having both closed and open cells but in some instances may be reticulated foam structures. The term "reticulated" generally refers to a cellular foam structure in which the substantially all of the membrane windows are removed leaving a skeletal structure. In contrast, open cell structures include both open cell (interconnected cells) and closed cells.

Unfortunately, the high density of foams used in current mattress assemblies, particularly those employing memory foam layers, generally prevents proper ventilation. As a result, the foam material can exhibit an uncomfortable level of heat to the user after a period of time.

BRIEF SUMMARY

Disclosed herein are mattress assemblies and molded foam layers for a mattress assembly exhibiting increased airflow and/or cooling to an end user. In one or more embodiments, the mattress assembly includes a viscoelastic thermally conductive infused polyurethane foam top layer; a multilayer composite structure including a molded viscoelastic foam layer and a perforated viscoelastic foam layer overlying the molded viscoelastic foam layer, wherein the molded viscoelastic foam layer includes a plurality of interconnected parallelpipedal bodies, wherein each parallelpipedal body includes an opening extending from a bottom surface to a top surface and is separated from an adjacent parallelpipedal body by a notch, and wherein the perforated viscoelastic foam layer comprises a plurality of perforations extending from a bottom surface to a top surface thereof, wherein at least a portion of the perforations overlies the opening in the parallelpipedal bodies; and a base core layer, wherein the composite overlies the base core layer.

In one or more embodiments, a molded foam layer for a mattress assembly includes a plurality of interconnected parallelepipedal-shaped bodies having a bottom planar surface and a substantially planar top surface, the plurality of interconnected parallelepipedal-shaped bodies including a bottom foam portion, a notch extending from the top planar surface towards the bottom planar surface between each adjacent parallelepipedal-shaped body, and an opening extending from the top planar surface to the bottom planar surface.

In one or more embodiments, a mattress assembly includes a viscoelastic foam top layer including a plurality of thermally conductive particles therein, and a phase change material; a perforated viscoelastic foam layer; a molded foam layer comprising a plurality of interconnected parallelepipedal-shaped bodies having a bottom planar surface and a substantially planar top surface, the plurality of interconnected parallelepipedal-shaped bodies including a bottom foam portion, a notch extending from the top planar surface towards the bottom planar surface between each adjacent parallelepipedal-shaped body, and an opening extending from the top planar surface to the bottom planar surface, wherein the perforated foam layer is adhesively affixed to the molded foam layer; and a base core layer, wherein the molded foam layer adhesively affixed to the base core layer.

The disclosure may be understood more readily by reference to the following detailed description of the various features of the disclosure and the examples included therein.

BRIEF DESCRIPTION OF THE SEVERAL VIEWS OF THE DRAWINGS

The specifics of the exclusive rights described herein are particularly pointed out and distinctly claimed in the claims at the conclusion of the specification. The foregoing and other features and advantages of the embodiments of the invention are apparent from the following detailed description taken in conjunction with the accompanying drawings.

DETAILED DESCRIPTION

Figure 1:
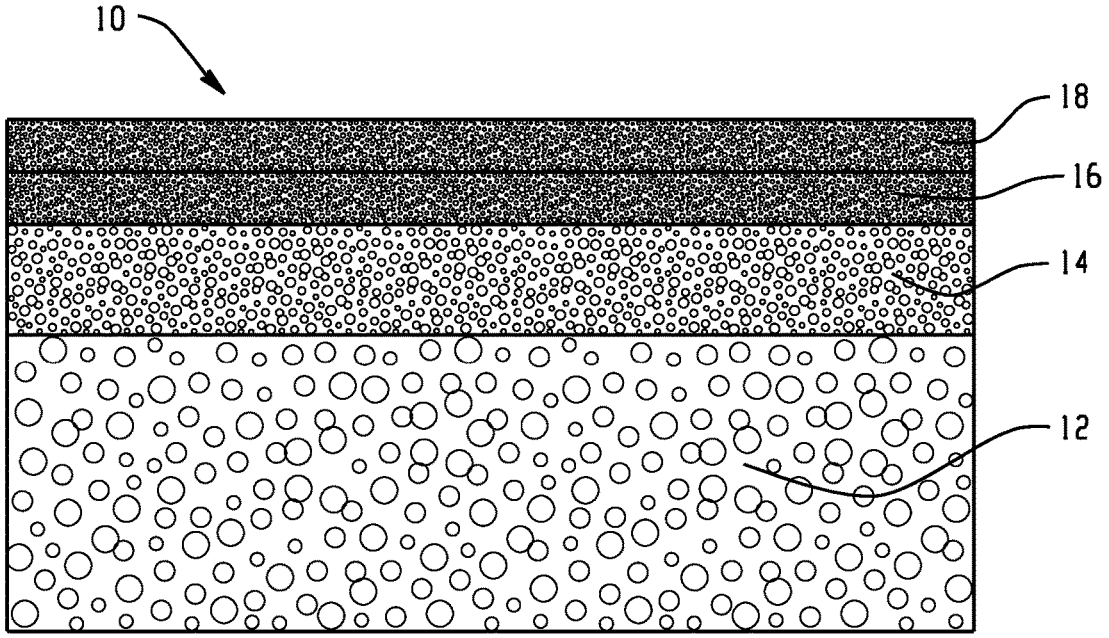
FIG. 1 illustrates a cross sectional view of an exemplary mattress assembly in accordance with one or more embodiments of the present invention.
Figure 2:
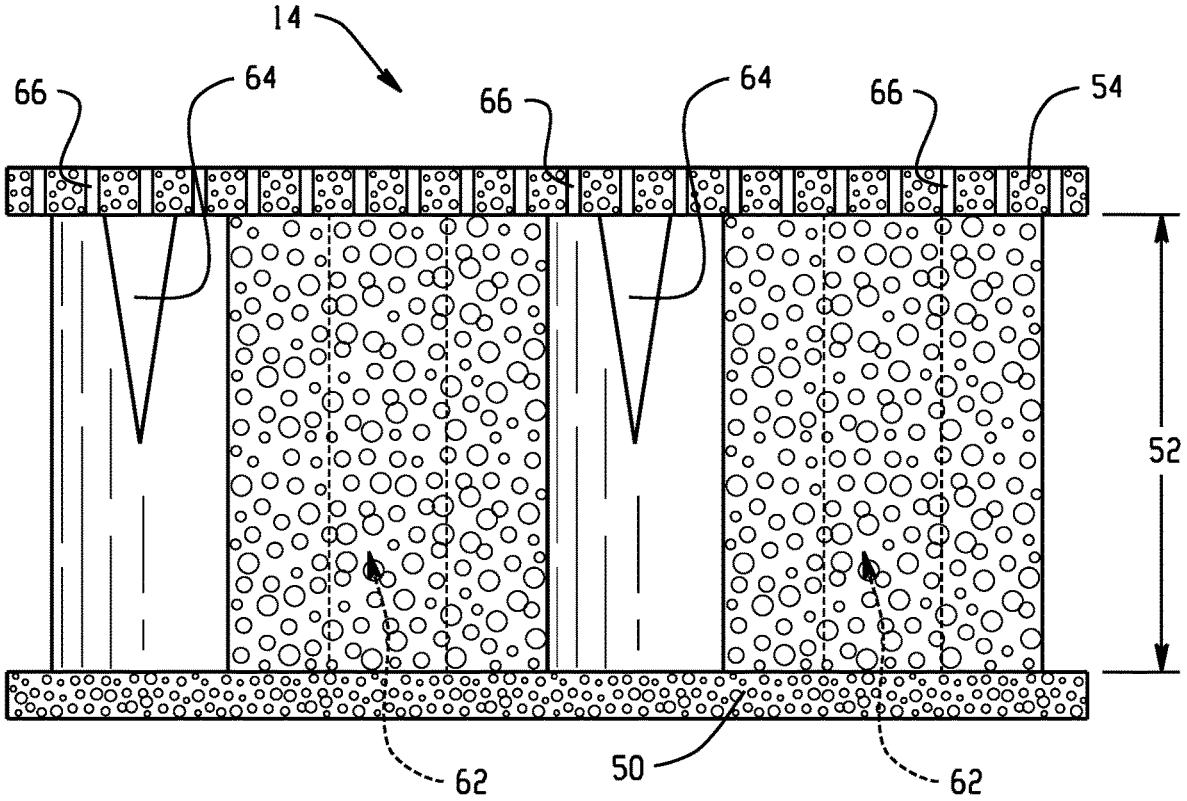
FIG. 2 illustrates a cross sectional view of a composite including a top perforated viscoelastic layer, a molded viscoelastic middle foam layer, and a bottom layer for use in an exemplary mattress assembly in accordance with one or more embodiments of the present invention.
Figure 3:
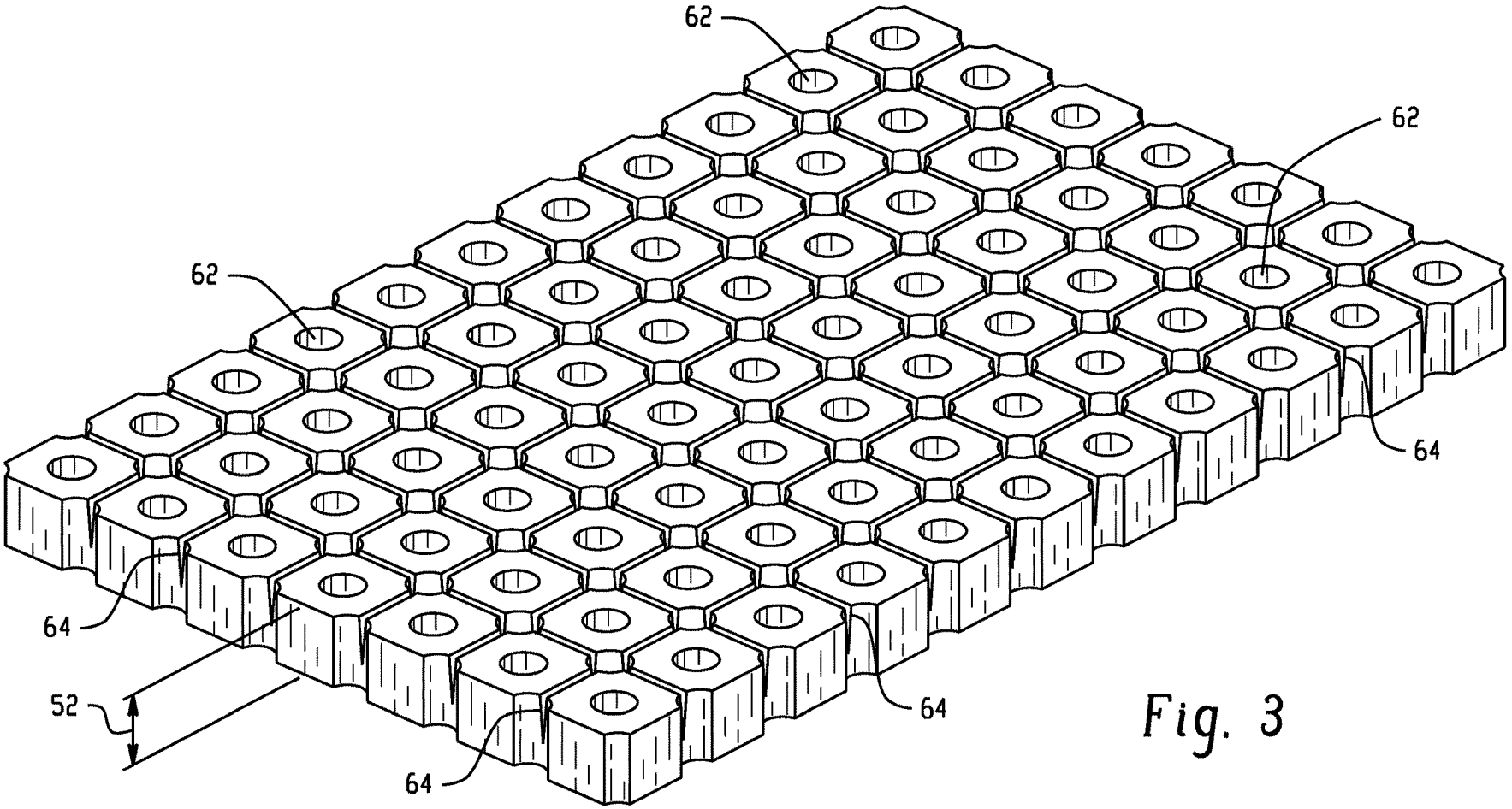
FIG. 3 pictorially illustrates a perspective view of a molded viscoelastic middle foam layer for use in the exemplary mattress assembly in accordance with one or more embodiments of the present invention.
Figure 4:
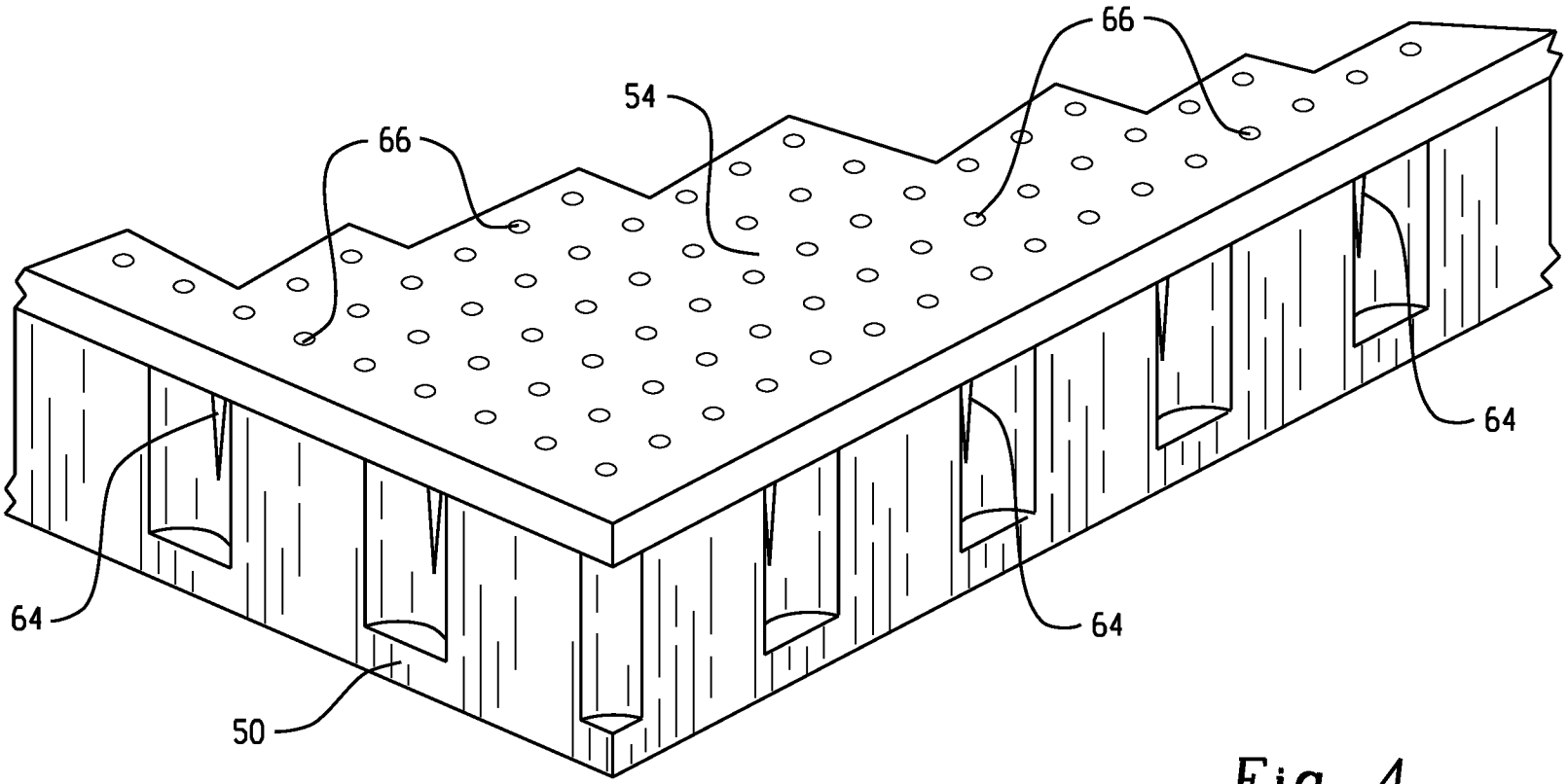
FIG. 4 pictorially illustrates a cross sectional view of a molded viscoelastic middle foam layer for use in the exemplary mattress assembly in accordance with one or more embodiments of the present invention.
Figure 5:
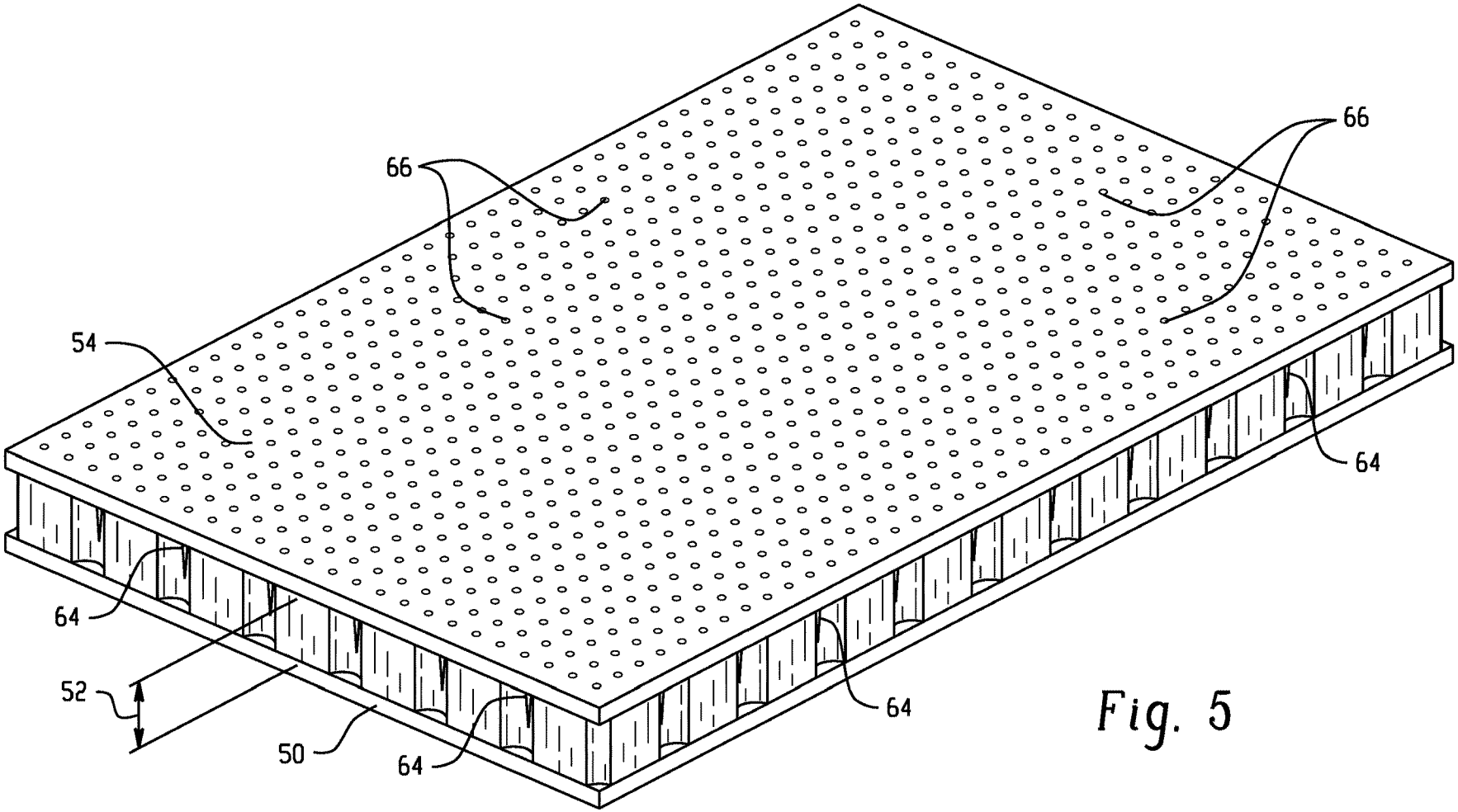
FIG. 5 pictorially illustrates a perspective view of a composite for use in the exemplary mattress assembly in accordance with one or more embodiments of the present invention; and In the accompanying figures and following detailed description of the described embodiments, the various elements illustrated in the figures are provided with two or three digit reference numbers. With minor exceptions, the leftmost digit(s) of each reference number correspond to the figure in which its element is first illustrated.

Disclosed herein are mattress assemblies that provide improved user comfort, e.g., improved airflow and/or cooling to effectively dissipate user heat during use, among other advantages. The mattress assemblies generally include a molded foam layer including a plurality of interconnected parallelepipedal-shaped foam bodies, wherein each of the parallelepipedal-shaped foam bodies is separated by a notch and has an opening within each extending from a planar top surface top to a planar bottom surface. During use, the interconnected parallelepipedal-shaped foam bodies are oriented such that the notch extends from the top surface towards a bottom surface of the parallelepipedal-shaped foam bodies so as to provide the interconnected parallelepipedal-shaped foam bodies with independent suspension with the openings providing cooling as well as enhanced decompression by evacuation of air. The openings can be off center or centrally located. In one or more embodiments, the molded foam layer is a viscoelastic foam.

The mattress assemblies may be a mattress of any size, including standard sizes such as a twin, queen, oversized queen, king, or California king sized mattress, as well as custom or non-standard sizes constructed to accommodate a user or a particular room. The mattress assemblies are generally configured as one sided but could be modified to provide two-sided mattresses depending on the desired properties.

Various embodiments of the present invention are described herein with reference to the related drawings. Alternative embodiments can be devised without departing from the scope of this invention. For the sake of brevity, conventional techniques related to mattress assembly fabrication may or may not be described in detail herein. Moreover, the various tasks and process steps described herein can be incorporated into a more comprehensive procedure or process having additional steps or functionality not described in detail herein. In particular, various steps in the manufacture of mattress assemblies are well known and so, in the interest of brevity, many conventional steps will only be mentioned briefly herein or will be omitted entirely without providing the well-known process details.

Although various connections and positional relationships (e.g., over, below, adjacent, etc.) are set forth between elements in the following description and in the drawings, persons skilled in the art will recognize that many of the positional relationships described herein are orientation-independent when the described functionality is maintained even though the orientation is changed. These connections and/or positional relationships, unless specified otherwise, can be direct or indirect, and the present invention is not intended to be limiting in this respect. Similarly, the term "coupled" and variations thereof describes having a communications path between two elements and does not imply a direct connection between the elements with no intervening elements/connections between them. All of these variations are considered a part of the specification. Accordingly, a coupling of entities can refer to either a direct or an indirect coupling, and a positional relationship between entities can be a direct or indirect positional relationship. As an example of an indirect positional relationship, references in the present description to forming layer "A" over layer "B" include situations in which one or more intermediate layers (e.g., layer "C") is between layer "A" and layer "B" as long as the relevant characteristics and functionalities of layer "A" and layer "B" are not substantially changed by the intermediate layer(s).

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection."

References in the specification to "one embodiment," "an embodiment," "an example embodiment," etc., indicate that the embodiment described can include a particular feature, structure, or characteristic, but every embodiment may or may not include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

For purposes of the description hereinafter, the terms "upper," "lower," "right," "left," "vertical," "horizontal," "top," "bottom," and derivatives thereof shall relate to the described structures and methods, as oriented in the drawing figures. The terms "overlying," "atop," "on top," "positioned on" or "positioned atop" mean that a first element, such as a first structure, is present on a second element, such as a second structure, wherein intervening elements such as an interface structure can be present between the first element and the second element. The term "direct contact" means that a first element, such as a first structure, and a second element, such as a second structure, are connected without any intermediary conducting, insulating or semiconductor layers at the interface of the two elements.

Spatially relative terms, e.g., "beneath," "below," "lower," "above," "upper," and the like, can be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device can be otherwise oriented (rotated 90 degrees or at other orientations) and the spatially relative descriptors used herein interpreted accordingly.

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

FIG. 1 illustrates a cross-sectional view representative of an exemplary mattress assembly, which is generally designated by reference numeral 10. The mattress assembly 10 generally includes a base core foam layer 12 configured with generally planar top and bottom surfaces, a molded foam composite layer 14, which can include a molded foam layer including interconnected parallelepipedal-shaped foam bodies on the base core foam layer 12, and one or more foam layers on the molded foam layer 14, two of which are shown and indicated by reference numerals 16, 18.

In one or more embodiments, the top layer 18, i.e., the cover layer, is formed of a thermally conductive viscoelastic foam, which provides enhanced cooling to the end user of the mattress assembly.

The various layers 12, 14, 16 and 18 may be adjoined to one another using an adhesive or may be thermally bonded to one another or may be mechanically fastened to one another.

For this as well as the other embodiments disclosed herein, the base core foam layer 12 is chosen to have a thickness of about 4 inches to about 10 inches, with about 6 inches to about 8 inches thickness in other embodiments, and about 6.5 inches in still other embodiments. The base core foam layer 12 can be formed of standard polyurethane foam although other foams can be used, including without limitation, viscoelastic foams, latex foams, and the like. In one or more embodiments, the base core foam layer 12 is an open cell polyurethane foam. In other embodiments, the base core foam layer 12 can be a closed cell polyurethane foam. In still other embodiments, the base core foam layer can be a viscoelastic foam. The base core foam layer 12 has a density of 1 pound per cubic foot (lb/ft$^3$) to 5 lb/ft$^3$. In other embodiments, the density is 1 lb/ft$^3$ to 3 lb/ft$^3$ and in still other embodiments, from 1 lb/ft$^3$ to 2 lb/ft$^3$. By way of example, the density can be 1.65 lb/ft$^3$. The hardness of the base core foam layer, also referred to as the indention load deflection (ILD) or indention force deflection (IFD), is within a range of 20 to 40 pounds-force, wherein the hardness is measured in accordance with ASTM D-3574 and is generally defined as the amount of force in pounds required to indent a 50" disc into a 15"×15"×4" foam sample and make a 1" indentation. In one or more embodiments, the hardness is about 32 to 35 pounds-force.

The molded foam layer 14 includes a layer of interconnected parallelepipedal-shaped foam bodies and is configured to provide increased airflow and independent suspension. Referring now to FIGS. 2-5, the molded foam layer 14 is integrally formed using well known foam molding techniques and generally includes a plurality of parallelepipedal-shaped foam bodies 52 extending from a bottom foam portion 50. The bottom foam portion 50 has a substantially uniform longitudinal thickness, which is not intended to be limited to any particular thickness. By way of example, the bottom foam portion 50 can have a thickness ranging from about 0.25 inches to about 4 inches. In one or more embodiments, the bottom foam portion 50 can have a thickness of about 0.5 inches to about 2 inches and in still other embodiments, the bottom foam portion 50 can have a thickness of about 0.5 inches to about 1.25 inches. In one or more embodiments, the bottom foam portion 50 is provided as a separate layer and the molded interconnected parallelepipedal-shaped foam bodies are adhesively affixed thereto. In other embodiments, the bottom foam portion 50 is integral with and molded with the interconnected parallelepipedal-shaped foam bodies 52.

Each one of the interconnected parallelepipedal-shaped foam bodies 52 are separated from one another by a notch 64, which provides the interconnected parallelepipedal-shaped foam bodies 52 with independent suspension during use thereof. The notch 64 generally extends from a top planar surface of the interconnected parallelepipedal-shaped foam bodies 52 to less than the bottom surface thereof extending through the bottom portion 50. Generally, the notch 64 extends about 75% or less from the top planar surface of the interconnected parallelepipedal-shaped foam bodies 52 towards the bottommost surface thereof. In one or more embodiments, the notch 64 extends about 50% or less from the top surface of the interconnected parallelepipedal-shaped foam bodies 52 towards the bottommost surface thereof. In one or more embodiments, the notch 64 is V-shaped. Although reference is made to a V-shaped notches, other shapes are contemplated, and it is not intended to be limited to the V-shaped notch as shown.

Each of the interconnected parallelepipedal-shaped foam bodies 52 further includes an opening 62 extending from top planar surface to a bottom planar surface of the bottom portion 50. If the bottom foam portion 50 is molded thereto or a separate layer, the opening extends from the top surface of the parallelepipedal-shaped foam body to the top surface of the bottom foam portion. The opening 62 can be centrally located with respect to the top surface of the parallelepipedal-shaped foam body 52 or can be offset as may be desired for other applications.

The bottom foam portion 50 and the parallelepipedal-shaped foam bodies 52 can be formed of the same material if molded together or may be different materials if the bottom foam portion 50 is fabricated as a separate layer. In one or more embodiments, the bottom foam portion 50 and/or the parallelepipedal-shaped foam bodies 52 are formed of a viscoelastic polyurethane foam. Other suitable foam include, but are not limited to, latex foams, polyurethane foams, and the like.

Although reference has been made to parallelepipedal-shaped foam bodies as illustrated and discussed herein, it should be apparent that other shapes are contemplated. For example, truncated cone bodies can be used and will generally include similar centrally located or offset openings as the parallelepipedal-shaped foam bodies.

In one or more embodiments, the bottom foam layer 50 and/or the parallelepipedal-shaped foam bodies 52 have a density of 1 pound per cubic foot (lb/ft) to 5 lb/ft$^3$. In other embodiments, the density is 1 lb/ft$^3$ to 3 lb/ft$^3$ and in still other embodiments, from 1 lb/ft$^3$ to 2 lb/ft$^3$. By way of example, the density can be 1.5 lb/ft$^3$. The hardness of the bottom foam layer 50 and/or the parallelepipedal-shaped foam bodies 52 are within a range of 20 to 40 pounds-force. In one or more embodiments, the bottom foam layer 50 and/or the parallelepipedal-shaped foam bodies 52 are selected to have a hardness within a range of about 25 to 35 pounds-force. By way of example, the hardness can be about 33 pounds-force.

A perforated viscoelastic foam polyurethane layer 54 having planar top and bottom surfaces overlies and is adhesively affixed to the molded foam layer 14 including the parallelepipedal-shaped foam bodies 52, The number and diameter of the perforations 66 is not intended to be limited provided at least a portion of the perforations 66 overlie and are in fluid communication with the openings 62 in the molded the parallelepipedal-shaped foam bodies 52. In one or more embodiments, the perforations 66 can be uniformly distributed throughout the layer 54. In one or more other embodiments, the perforations 66 can be randomly distributed throughout the layer 54. The diameter of the perforations 66 can be the same or different throughout the layer. Generally, the perforations 66 have a diameter that is a fraction of the diameter associated with the openings 62 in the parallelepipedal-shaped foam bodies 52. In one or more embodiments, the diameter of the perforations 66 is less than 50% of the diameter of the openings 62 in the parallelepipedal-shaped foam bodies 52; in other embodiments, the diameter of the perforations is less than 30% of the diameter of the openings 62 in the parallelepipedal-shaped foam bodies 52; and in still other embodiments, diameter of the perforations is less than 20% of the diameter of the openings 62 in the parallelepipedal-shaped foam bodies 52.

In this manner, compression of the various foam layers in the mattress assembly during use causes air to be evacuated from the openings 62, 66 changing he compression profile whereas decompression results in airflow into the openings 62 and 66 of the parallelepipedal-shaped foam bodies 52, which can provide a cooling action to the end user. Moreover, improved comfort is realized with the independent suspension provided by the molded foam layer 14 including the parallelepipedal-shaped foam bodies 52.

The thickness of the perforated viscoelastic layer 54 is about ½ inch to about 4 inches; and in still other embodiments, the thickness is within a range of about ½ inch to about 2 inches. The perforated viscoelastic layer 54 has a density of 1 pound per cubic foot (lb/ft$^3$) to 5 lb/ft$^3$. In other embodiments, the density is 1 lb/ft to 3 lb/ft$^3$ and in still other embodiments, from 2 lb/ft$^3$ to 3 lb/ft$^3$. By way of example, the density can be 2.6 lb/ft$^3$. In one or more embodiments, the perforated viscoelastic layer 54 and the bottom foam layer 50 are laminated to the molded viscoelastic middle foam layer 52.

Layer 16 can be composed of one or more foam layers such as a polyurethane foam, latex foam viscoelastic foam, or the like having planar top and bottom surfaces disposed on the perforated viscoelastic layer 54. Layer 16 is generally characterized as having a thickness of 1 to 3 inches, a density of 1 to 4 lb/ft$^3$, and a hardness of 10 to 20 pounds-force. In one embodiment, layer 16 is a viscoelastic polyurethane foam layer having a thickness of 1.5", and a density of about 3.4 lb/ft$^3$.

Optionally, layer 16 can be a gel infused viscoelastic foam layer having planar top and bottom surfaces. Suitable gel infused viscoelastic layers are generally disclosed in US Pat. No. 2010/0005595 to Gladney et al., which is incorporated by reference in its entirety. In one embodiment, the gel infused viscoelastic foam layer is infused with gel at less than about 50 percent by weight of the total weight of the viscoelastic foam layer in some embodiments, with less than 40 percent by weight in other embodiments, and with less than 35 percent in still other embodiments. In one or more embodiments, the gel infused visco elastic foam layer 16 is formed of a non-random open cell polyurethane viscoelastic foam having a thickness of 0.5 to 2 inches, a density of 3 to 6 lb/ft$^3$ and a hardness of 10 to 15 pounds-force. In one embodiment, the gel infused viscoelastic foam layer 307 has a 36 percent by weight gel loading, a density of 4.5 lb/ft$^3$, and a hardness of 11 pounds-force.

Uppermost layer 18, also referred to herein as a cover panel, can be formed of a viscoelastic thermally conductive infused polyurethane foam and can overly foam layer 16. The viscoelastic thermally conductive infused polyurethane foam in this embodiment as well as in the other embodiments disclosed herein where a viscoelastic foam is utilized in the mattress assembly can have an open cell structure, wherein the percentage of intact windows (i.e., cell walls) between adjacent cells is less than 50 percent in one embodiment, and less than 40 percent in other embodiments, and less than 30 percent in still other embodiments. The top layer 18 in this embodiment has planar top and bottom surfaces. The thickness is generally greater than W inch inches to 5 inches in some embodiments, and greater than 1 inch to about 3 inches in other embodiments.

In one or more embodiments, the viscoelastic thermally conductive infused polyurethane foam top layer 18 includes a plurality of carbon fibers such as is disclosed in US Pat. Pub. No. 2019/0153286 to Peterson et al, incorporated herein by reference in its entirety. Alternatively, the thermally conductive infused polyurethane foam layer can include a plurality of thermally conductive metals such as, but not limited to, metals, metal oxides, polymers, inorganic compounds and the like. By way of example, suitable materials may be made of carbon, graphene, graphite, platinum, aluminum, diamond, gold, silver, silicon, copper, iron, nickel, and the like; polymers such as stretched polyethylene nanofibers; and the like, and mixtures thereof. In most embodiments, the selected material has a thermal conductivity greater than 10 watts per meters-Kelvin (W/m*K). By way of example, aluminum has a thermal conductivity of about 235 W/m*K; stretched polyethylene fibers is estimated to be about 180 W/m*K, and graphene has a theoretical conductivity of about 5000 W/m*K.

The thermally conductive filler loading will generally depend on the foam matrix, the filler form, and the inherent thermal conductivity of the filler material incorporated in the foam matrix. The amount selected can he from greater than zero weight percent to less than about 75 weight percent, wherein the filler weight percent is based on net weight of foam. In some embodiments, a gradient of the thermally conductive filler material within the foam matrix is provided. The gradient may increase from the top of the foam layer to the bottom of the foam layer, wherein top and bottom refer to orientation of the foam layer relative to a sleeping surface of the mattress such that the top surface is adapted to substantially face the user resting upon the bed mattress. In other embodiments, the gradient may decrease from the top of the foam layer to the bottom of the foam layer.

The particular thermally conductive material is not intended to be limited. The viscoelastic thermally conductive infused polyurethane foam top layer 18 provides a cooler and more comfortable sleep or contact.

Heat transfer consists of a combination of conduction, convection and radiation. In a mattress or bedding, heat transfer by radiation is not very large. Instead, heat transfer by conduction and convection are the primary paths for moving heat in a mattress or bedding. As a person sleeps on a mattress, the compressed foam underneath the body typically has reduced air flow paths, and the primary mode in the region below the body is conduction. Heat is conducted from the body, through the compressed foam, into mattress or bedding regions where the foam is not compressed as much, which allows natural convection to occur more readily to remove heat from the mattress. A cooler and more comfortable sleep may be obtained by increasing the thermal conductivity of a mattress or bedding and allowing the heat from the body to migrate away more rapidly.

Enhanced heat transfer reduces the amount of a temperature gradient that is required to generate a given amount of heat flow. This means that for the same amount of body heat, a mattress or bedding with uppermost foam layer 18 will be able to have a lower surface temperature of the foam in contact with a person, while still conducting the heat away. This will result in a cooler sleep.

In one or more embodiments, the uppermost foam layer 18 can further include a phase change material. In one or more embodiments, the phase change material is uniformly dispersed throughout the top layer 18. In still other embodiments, the phase change material is provided only in an area corresponding to the lumbar region of the mattress assembly.

Addition of phase change materials to the viscoelastic thermally conductive infused polyurethane foam top layer 18 allows the layer 18 to store or release energy, which is higher than heat absorbed or released by heat capacity of the non-thermally enhanced construction. Heat is stored if the solid phase change material changes to a liquid, and heat is released when the liquid phase change material changes to a solid. The melting point temperature is usually chosen to be in the 20° C. independently to 35° C. range to match the human comfort zone. Once the solid phase change material melts completely, all of the latent heat is used, and the phase change material must be cooled below its melting point to solidify the phase change material and regenerate for the next melt cycle. Suitable phase change materials have a solid/liquid phase transition temperature from −10° F. independently to 220° F. (about −23° C. independently to about 104° C.). In another non-limiting version, the phase change solid/liquid phase transition temperature is from 68° F. independently to 95° F. (about 20° C. independently to about 35° C.).

Optionally, one or more of the foam layers can be pre-stressed. That is, one or more of the foam layers can be subjected to a pre-stressing process such as disclosed in U.S. Pat. No. 7,690,096 to Gladney et al., incorporated herein by reference in its entirety. By way of example, a force can applied to at least a section of the foam layer in an amount sufficient to temporarily compress its height so as to permanently alter a mechanical property of the foam layer to provide a pre-stressed foam layer having a firmness that is different from the firmness of a similar foam that was not pre-stressed.

The mattress assemblies in accordance with the present invention may include other layers, such as batting, foam, waterproof liners, fabric, and so forth. The mattress assemblies, and any variations thereof, may be manufactured using techniques known in the art of mattress making, with variations to achieve the mattress described above. Likewise, the various mattress layers in the mattress assemblies described above may be adjoined to one another using an adhesive or may be thermally bonded to one another or may be mechanically fastened to one using another hog rings, staples, and/or other techniques known in the art.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mattress assembly, comprising:

a viscoelastic thermally conductive infused polyurethane foam top layer;

a multilayer composite structure comprising a molded foam layer and a perforated viscoelastic foam layer overlying the molded foam layer, wherein the molded foam layer consists of a plurality of interconnected parallelpipedal bodies extending from a bottom portion free of through holes, wherein each parallelpipedal body consists of a centrally located opening extending from a top planar surface thereof, and a concave surface at each corner of the parallelpipedal body to the top surface defining, the bottom portion to define a secondary opening extending from the top planar surface to the top surface defining the bottom portion at an intersection between four adjacent parallelpipedal bodies and is separated from each adjacent parallelpipedal body by a v-shaped notch partly extending from the top planar surface towards the bottom portion, the v-shaped notch extending in downwards between adjacent corners of the adjacent parallelpipedal bodies, and wherein the perforated viscoelastic foam layer comprises a plurality of perforations extending from a bottom surface to a top surface thereof, wherein at least a portion of the perforations overlies the centrally located openings in the parallelpipedal bodies such that during use compression causes air to be evacuated rom the centrally located opening and the perforations whereas decompression results in airflow into the centrally located opening and perforations: and a base core layer, wherein the multilayer composite structure overlies the base core layer.

2. The mattress assembly of claim 1, wherein the viscoelastic thermally conductive infused polyurethane foam top layer comprises carbon fiber infused viscoelastic polyurethane foam.

3. The mattress assembly of claim 1, wherein the viscoelastic thermally conductive infused polyurethane foam top layer further comprises a phase change material.

4. The mattress assembly of claim 1, further comprising a viscoelastic layer intermediate the viscoelastic thermally conductive infused polyurethane foam top layer and the composite.

5. The mattress assembly of claim 1, wherein each of the perforations in the perforated layer has a diameter that is a fraction of a diameter of the centrally located openings in the interconnected parallelpipedal bodies.

6. The mattress assembly of claim 1, wherein the notches extend from the top planar surface towards the bottom portion wherein each of the v-shaped notches extend about 75% of the thickness of the interconnected parallelepipedal bodies.

7. The mattress assembly of claim 1, wherein the notches extend from the top planar surface towards the bottom portion wherein each of the v-shaped notches extend about 50% of the thickness of the interconnected parallelepipedal bodies.

8. The mattress assembly of claim 1, wherein the notches extend from the top planar surface towards the bottom portion wherein each of the v-shaped notches extend about 25% of the thickness of the interconnected parallelepipedal bodies.

9. The mattress assembly of claim 1, wherein the diameter for each of the perforations in the perforated viscoelastic foam layer is less than 50% of a diameter for each of the centrally located openings in the parallelepipedal-shaped foam bodies.

10. A molded foam layer for a mattress assembly consisting of:

a plurality of interconnected parallelepipedal-shaped foam bodies having a bottom planar surface and a top planar surface e di from a bottom portion free of throughholes, wherein each parallelpipedal body consists of a centrally located opening extending from the top planar surface thereof to a top surface defining the bottom portion, and a concave surface at each corner of the parallelpipedal body to define a secondary opening extending from the top planar surface to the top surface defining the bottom portion at an intersection between four adjacent parallelpipedal bodies and is separated from each adjacent parallelpipedal body by a v-shaped notch partly extending from the top planar surface towards the top surface defining the bottom portion, the v-shaped notch extending downwards between adjacent corners of the adjacent parallelpipedal bodies.

11. The molded foam layer of claim 10, wherein the notch extends from the top planar surface towards the bottom portion wherein each of the v-shaped notches extend about 75% of the thickness of the interconnected parallelepipedal bodies.

12. The molded foam layer of claim 10, wherein the notch extends from the top planar surface towards the bottom portion wherein each of the v-shaped notches extend about 50% of the thickness of the interconnected parallelepipedal bodies.

13. The molded foam layer of claim 10, wherein the molded foam layer is a viscoelastic foam.

14. The molded foam layer of claim 13, wherein the viscoelastic foam has a density of 1 pound per cubic foot ($lb/ft^3$) to 5 $lb/ft^3$, and a hardness within a range of 20 to 40 pounds-force.

15. A mattress assembly comprising:

a viscoelastic foam top layer comprising a plurality of thermally conductive particles therein, and a phase change material;

a perforated viscoelastic foam layer;

a molded foam layer consisting of a plurality of interconnected parallelepipedal-shaped bodies having a bottom planar surface and a substantially planar top surface, wherein each parallelpipedal body consists of a centrally located opening extending from a top planar surface thereof to a top surface defining a bottom portion free of throughholes, a concave surface at each corner of the parallelpipedal body to define a secondary opening extending from the top planar surface to the top surface defining the bottom portion at an intersection between four adjacent parallelpipedal bodies and is separated from each adjacent parallelpipedal body by a v-shaped notch partly extending from the top planar surface towards the top surface defining the bbottom portion, the v-shaped notch extending downwards between adjacent corners of the adjacent parallelpipedal bodies, wherein the perforated foam layer is adhesively affixed to the molded foam layer; and a base core layer, wherein the molded foam layer adhesively affixed to the base core layer.

16. The mattress assembly of claim 15, wherein the base core layer comprises a polyurethane foam.

17. The mattress assembly of claim 15, wherein the plurality of thermally conductive particles are selected from the group consisting of carbon, graphene, graphite, platinum, aluminum, gold, silver, silicon, copper, iron, nickel, stretched polyethylene nanofibers, and mixtures thereof.

18. The mattress assembly of claim 15, wherein the plurality of thermally conductive particles in the polymeric elastomer foam matrix define a gradient having a concentration of thermally conductive particles decreasing from a top surface to a bottom surface of the thermally conductive foam layer.

19. The mattress assembly of claim 15, wherein the molded foam layer is a viscoelastic foam.

* * * * *